US010095160B2

(12) United States Patent
Kosone et al.

(10) Patent No.: US 10,095,160 B2
(45) Date of Patent: Oct. 9, 2018

(54) DEVELOPING APPARATUS, PROCESS CARTRIDGE, AND IMAGE FORMING APPARATUS

(71) Applicant: CANON FINETECH NISCA INC., Misato-shi (JP)

(72) Inventors: Ryosuke Kosone, Nagareyama (JP); Ryo Nakajima, Nagareyama (JP); Naoki Tamaru, Kashiwa (JP)

(73) Assignee: CANON FINETECH NISCA INC., Misato-shi, Saitama (JP)

( * ) Notice: Subject to any disclaimer, the term of this patent is extended or adjusted under 35 U.S.C. 154(b) by 0 days.

(21) Appl. No.: 15/293,578

(22) Filed: Oct. 14, 2016

(65) Prior Publication Data

US 2017/0115599 A1 Apr. 27, 2017

(30) Foreign Application Priority Data

Oct. 26, 2015 (JP) ..... 2015-209688

(51) Int. Cl.
*G03G 15/08* (2006.01)
*G03G 21/18* (2006.01)

(52) U.S. Cl.
CPC ..... *G03G 15/0867* (2013.01); *G03G 15/0879* (2013.01); *G03G 15/0898* (2013.01); *G03G 21/18* (2013.01)

(58) Field of Classification Search
CPC ..... G03G 15/0867; G03G 15/0898; G03G 15/0879; G03G 21/18
See application file for complete search history.

(56) References Cited

U.S. PATENT DOCUMENTS 4,194,465 A * 3/1980 Tsukamoto ..... G03G 15/0898 399/103
4,377,334 A * 3/1983 Nishikawa ..... G03G 15/0898 399/103

(Continued)

FOREIGN PATENT DOCUMENTS

CA 2812902 A1 4/2012
EP 2624069 A1 8/2013

(Continued)

OTHER PUBLICATIONS

European Search Report dated Apr. 12, 2017, in related European Patent Application No. 16194719.7.

(Continued)

*Primary Examiner* — G. M. Hyder
(74) *Attorney, Agent, or Firm* — Fitzpatrick, Cella, Harper & Scinto

(57) ABSTRACT

An image forming apparatus includes a developing apparatus including a housing having a supply opening to receive developer supplied by a pump unit, a developing device screw disposed in a discharge path of the housing to supply and discharge the developer through a discharge opening to an image bearing member, and a developer bearing portion having a magnetic body that generates a magnetic force and is configured to bear the developer with a carrying force working in a substantially perpendicular direction to the magnetic force. In addition, a developer accommodation portion within the housing accommodates the developer supplied from a supply opening and has no opening other than the supply opening and the discharge opening, with the developer accommodation portion having a space volume capable of suppressing a spouting force caused by an inner pressure increase due to operation of the pump unit.

7 Claims, 9 Drawing Sheets

(56) References Cited

U.S. PATENT DOCUMENTS

| | | | | |
|---|---|---|---|---|
| 4,449,810 | A * | 5/1984 | Ikesue | G03G 15/09 355/71 |
| 5,960,238 | A * | 9/1999 | Ohgami | G03G 15/0874 141/330 |
| 7,577,377 | B2 | 8/2009 | Miyamoto et al. | |
| 9,632,455 | B2 | 4/2017 | Murakami et al. | |
| 2005/0117920 | A1* | 6/2005 | Ogata | G03G 15/0889 399/27 |
| 2008/0213684 | A1 | 9/2008 | Nagayama et al. | |
| 2009/0214268 | A1* | 8/2009 | Noh | G03G 15/0875 399/258 |
| 2012/0014722 | A1* | 1/2012 | Okino | G03G 15/0867 399/262 |
| 2013/0209134 | A1* | 8/2013 | Okino | G03G 15/0875 399/258 |
| 2013/0209140 | A1* | 8/2013 | Murakami | G03G 15/0875 399/258 |
| 2013/0266345 | A1 | 10/2013 | Matsumoto et al. | |
| 2014/0133889 | A1 | 5/2014 | Matsumoto et al. | |
| 2014/0169836 | A1* | 6/2014 | Nagashima | G03G 15/0879 399/258 |
| 2017/0176924 | A1* | 6/2017 | Murakami | G03G 21/1647 |

FOREIGN PATENT DOCUMENTS

| | | | |
|---|---|---|---|
| JP | S60-120376 | A | 6/1985 |
| JP | S62-143061 | A | 6/1987 |
| JP | 2006-133531 | A | 5/2006 |
| JP | 2006-251512 | A | 9/2006 |
| JP | 2007-058002 | A | 3/2007 |
| JP | 2012-093735 | A | 5/2012 |
| JP | 2012-093736 | A | 5/2012 |
| JP | 2013-218094 | A | 10/2013 |
| JP | 5836736 | B2 | 12/2015 |
| WO | 2012/043876 | A1 | 4/2012 |

OTHER PUBLICATIONS

Japanese Office Action dated Aug. 8, 2017, in related Japanese Patent Application No. 2015-209688.

Japanese Office Action dated Dec. 5, 2017, in related Japanese Patent Application No. 2015-209688.

Japanese Office Action dated May 15, 2018, in related Japanese Patent Application No. 2015-209688.

* cited by examiner

*FIG. 8*

$\mu = 0.55$

| PARAMETER | CONDITION 1 | CONDITION 2 | CONDITION 3 | CONDITION 4 |
|---|---|---|---|---|
| P1(Pa) | $1.01 \times 10^{5}$ | $1.01 \times 10^{5}$ | $1.01 \times 10^{5}$ | $1.01 \times 10^{5}$ |
| P2(Pa) | $1.06 \times 10^{5}$ | $1.10 \times 10^{5}$ | $1.12 \times 10^{5}$ | $1.27 \times 10^{5}$ |
| V1($cm^3$) | 340 | 197 | 340 | 187 |
| V2($cm^3$) | 325 | 182 | 310 | 149 |
| V3($cm^3$) | 15 | 15 | 30 | 38 |
| V3/V1(%) | 4% | 8% | 9% | 20% |
| L(m) | $3.10 \times 10^{-1}$ | $2.40 \times 10^{-1}$ | $3.10 \times 10^{-1}$ | $2.40 \times 10^{-1}$ |
| r(m) | $8.00 \times 10^{-5}$ | $8.00 \times 10^{-5}$ | $8.00 \times 10^{-5}$ | $8.00 \times 10^{-5}$ |
| N(N) | $3.28 \times 10^{-1}$ | $2.54 \times 10^{-1}$ | $3.28 \times 10^{-1}$ | $2.54 \times 10^{-1}$ |
| Fair(N) | $1.82 \times 10^{-1}$ | $1.60 \times 10^{-1}$ | $2.43 \times 10^{-1}$ | $4.96 \times 10^{-1}$ |
| Ftnr(N) | $2.04 \times 10^{-1}$ | $1.63 \times 10^{-1}$ | $2.04 \times 10^{-1}$ | $1.63 \times 10^{-1}$ |
| CALCULATION RESULT | NO SPOUTING OUT | NO SPOUTING OUT | WITH SPOUTING OUT | WITH SPOUTING OUT |
| EXPERIMENT RESULT | NO SPOUTING OUT | NO SPOUTING OUT | WITH SPOUTING OUT | WITH SPOUTING OUT |

*FIG. 9*

| PARAMETER | CONDITION 1 | CONDITION 2 |
|---|---|---|
| VOLUME OF DEVELOPING APPARATUS ($cm^3$) | 367 | 367 |
| VOLUME OF DEVELOPER ($cm^3$) | 140 | 135 |
| DEVELOPER IN DEVELOPING APPARATUS (%) | 38% | 37% |
| PRESENCE/ABSENCE OF VOID IMAGE | NO VOID IMAGE | WITH VOID IMAGE |

DEVELOPING APPARATUS, PROCESS CARTRIDGE, AND IMAGE FORMING APPARATUS

BACKGROUND OF THE INVENTION

Field of the Invention

The present invention relates to an image forming apparatus such as an electrophotographic copying machine, an electrophotographic printer (for example, a laser beam printer, and an LED printer), a facsimile device for forming an image on a recording medium by using an electrophotographic image forming method, a process cartridge detachably attachable to an image forming apparatus, and a developing apparatus incorporated into an image forming apparatus or a process cartridge.

Description of the Related Art

A developing apparatus used for an image forming apparatus includes a configuration for supplying a toner, which is consumed according to image formation, to a developing apparatus for performing developing process from a toner bottle accommodating a toner. In particular, there is a configuration having a toner bottle and a pump as a developer pressurizing supply mechanism, and supplying a toner to a developing apparatus from the developer pressurizing supply mechanism according to an increase in an internal pressure caused by a contraction of this pump.

However, in a configuration for supplying toner by using such pump, a change occurs in an internal pressure in the developing apparatus during toner supply, and accordingly, the internal pressure in the developing apparatus during the toner supply becomes larger than the air pressure outside of the device, so that the toner may spout out to the outside of the developing apparatus. Therefore, the method for preventing this has been disclosed in the past.

For example, Japanese Patent Laid-Open No. 2012-93736 discloses a configuration for supplying a toner to a developing apparatus via a conveying chamber having a conveying path from a pump accommodation unit having a pump, wherein the configuration prevents the toner from spouting out into the conveying chamber and has a filter for allowing air ventilation to the outside. With this configuration, air ventilation to the outside is conducted, so that the internal pressure is prevented from increasing, and the toner is prevented from spouting out to the outside of the developing apparatus.

However, in a configuration using a filter to prevent the internal pressure from increasing and prevent the toner from spouting out, e.g., the configuration described in Japanese Patent Laid-Open No. 2012-93736, the filter may be clogged due to a usage for a long period of time even if various kinds of countermeasures are taken. In a case when the filter is clogged, the air ventilation function of the filter is lost, and the internal pressure in the developing apparatus increases, and the toner spouts out from the developing apparatus, and the toner scatters in the image forming apparatus, and a sheet is smeared, and this may lead to a reduction in the quality of the image.

SUMMARY OF THE INVENTION

The present invention effectively prevents toner from spouting out from a developing apparatus, which occurs when an internal pressure in the developing apparatus increases.

An exemplary configuration of the present invention is a developing apparatus that includes: a supply path configured to supply a developer; a discharge path configured to discharge the developer supplied from the supply path and perform developing; a developer holding portion configured to exert a predetermined force for holding the developer at the discharge path; and a developer accommodation portion accommodating the developer which is supplied from the supply path, and having a space volume so that the developer does not spout out from the discharge path on which the predetermined force is exerted by the developer holding portion according to an increase in an internal pressure of the developer accommodation portion when the developer is supplied from the supply path in a state where a predetermined amount of the developer is accommodated.

According to the present invention, toner can be prevented from spouting out from a developing apparatus effectively, which occurs when an internal pressure in the developing apparatus increases.

Further features of the present invention will become apparent from the following description of exemplary embodiments with reference to the attached drawings.

BRIEF DESCRIPTION OF THE DRAWINGS

FIG. 8 is a table illustrating a result of an experiment indicating presence/absence of spouting out of toner to the outside of the developing device.

FIG. 9 is a table illustrating a result of an experiment indicating presence/absence of occurrence of void image of an image.

DESCRIPTION OF THE EMBODIMENTS

First Embodiment

<Image Forming Apparatus>

Hereinafter, the entire configuration of an image forming apparatus A according to the first embodiment of the present invention will be described together with an operation during image formation with reference to drawings.

Figure 1:
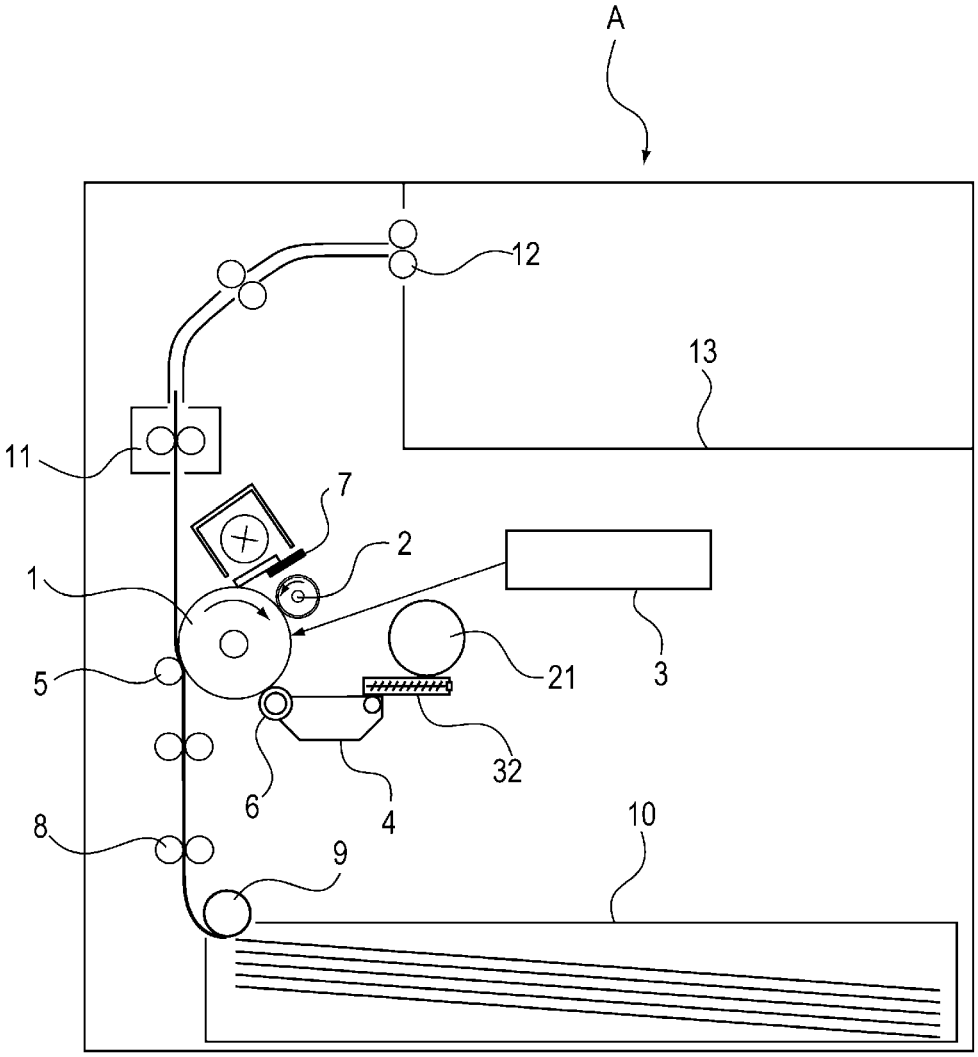
FIG. 1 is a cross sectional schematic view illustrating an image forming apparatus.

As illustrated in FIG. 1, the image forming apparatus A includes an image forming portion transferring a toner image to a sheet, a sheet feeding and conveying portion supplying a sheet to an image forming portion, and a fixing portion for fixing a toner image to a sheet.

The image forming portion includes a photosensitive drum 1 (image bearing member), a charging roller 2, a developing device 4 (developing apparatus), a cleaning blade 7, a transfer roller 5, and a laser scanner unit 3.

Figure 3A:
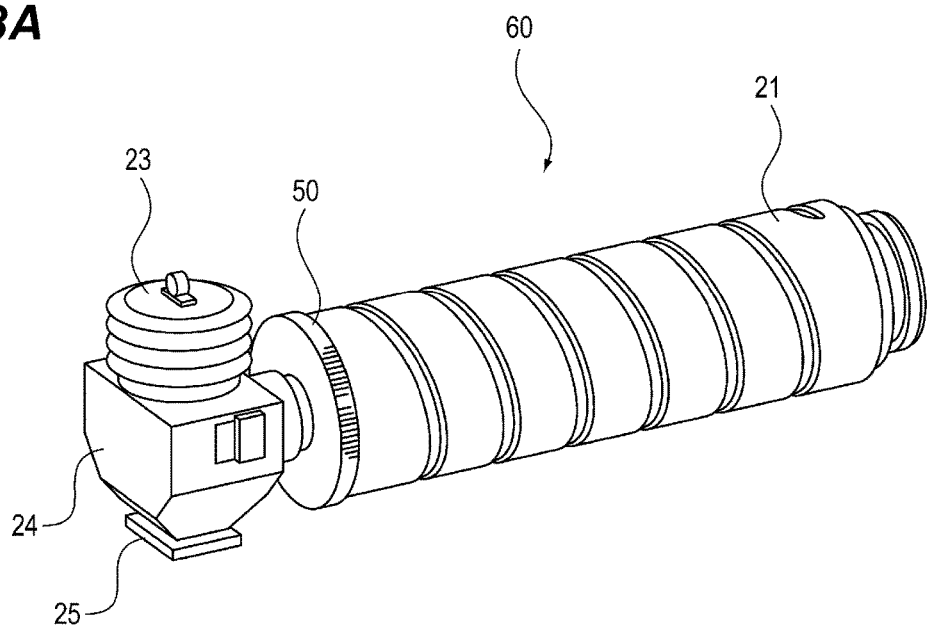
FIGS. 3A and 3B are a schematic perspective view and a cross sectional schematic view illustrating a toner pressurizing supply mechanism.
Figure 3B:
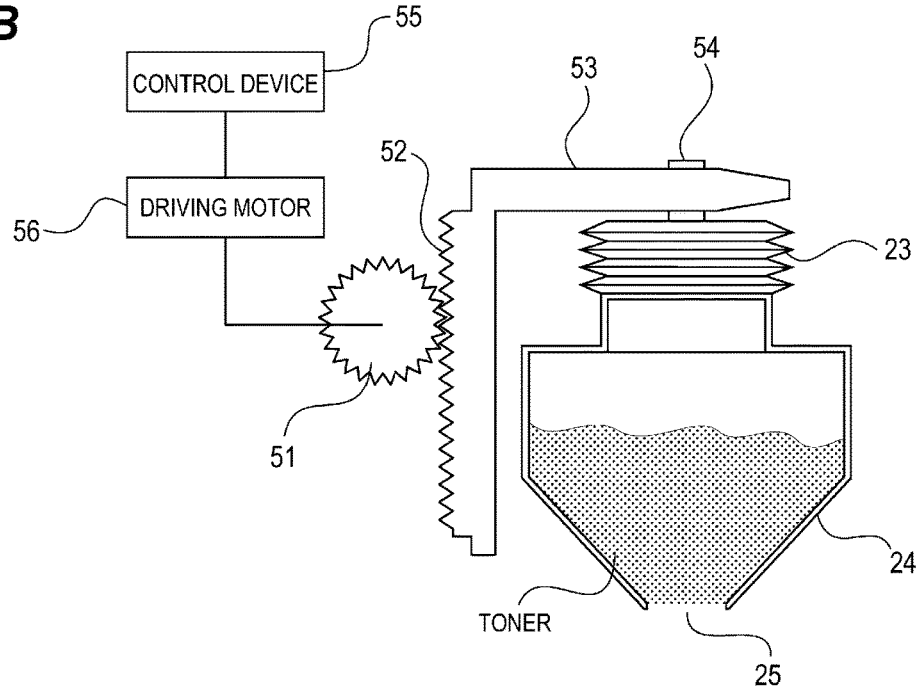

When an image is formed, a control device 55 emits a print signal as illustrated in FIG. 3B, and a feeding conveying roller 9 and a conveying roller 8 feeds a sheet stacked and accommodated on a sheet stacking portion 10 to the image forming portion.

On the other hand, at the image forming portion, the charging roller 2 applies a charging bias, so that the surface of the photosensitive drum 1 that comes into contact with the charging roller 2 is charged.

Thereafter, the laser scanner unit 3 emits laser light from a light source (not illustrated) provided therein, and irradiates laser light to the photosensitive drum 1. Therefore, the potential of the photosensitive drum 1 partially decreases, and an electrostatic latent image according to an image information is formed on the surface of the photosensitive drum 1.

Thereafter, when the developing bias is applied to the developing roller 6 provided in the developing device 4, toner is attached from the developing roller 6 to an electrostatic latent image formed on the surface of the photosensitive drum 1, so that a toner image is formed. A toner image formed on the surface of the photosensitive drum 1 is feed to a transfer nip portion formed between the photosensitive drum 1 and the transfer roller 5, each of which is provided to be rotatable. When the toner image arrives at the transfer nip portion, a transfer bias having a polarity opposite to the toner is applied to the transfer roller 5, so that the toner image is transferred to the sheet.

Thereafter, the sheet having the toner image transferred thereon is conveyed to a fixing device 11, and the toner image is heated and pressurized at a fixing nip portion formed between a heating portion and a pressurizing portion of the fixing device 11, so that the toner image is fixed on the sheet. Thereafter, the sheet is conveyed by an eject roller 12, and is ejected to a paper ejection portion 13.

<Toner Pressurizing Supply Mechanism>

Figure 2:
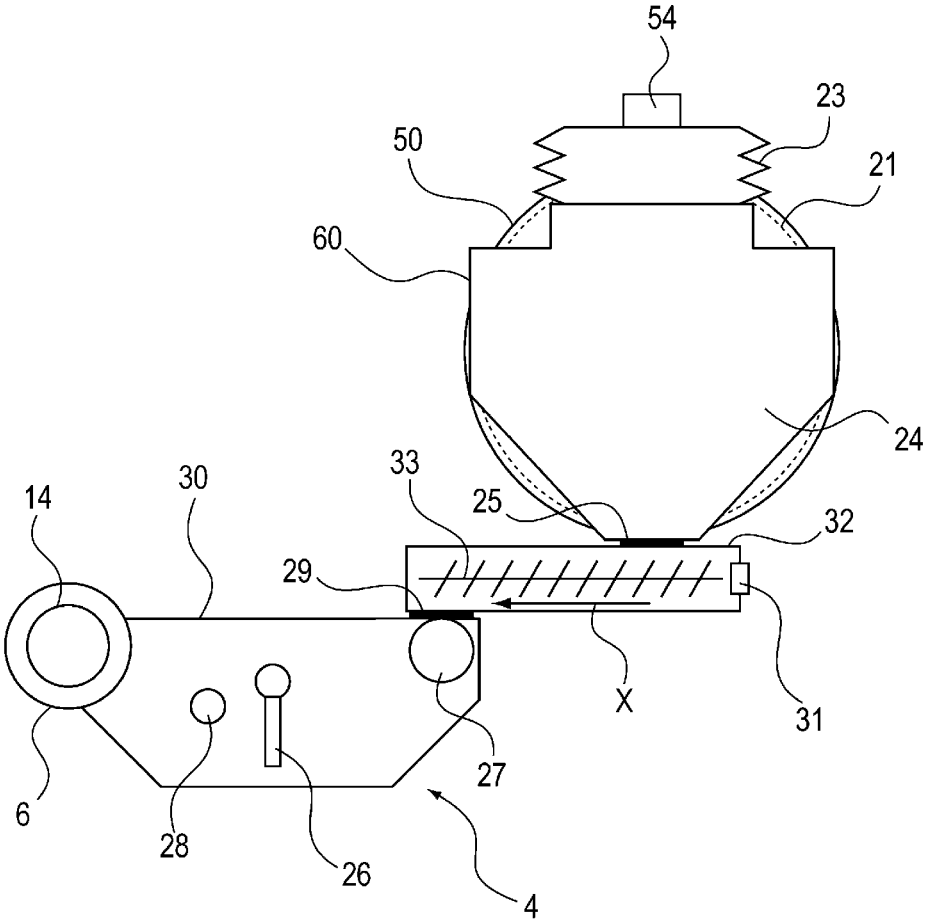
FIG. 2 is a cross sectional schematic view illustrating a toner pressurizing supply mechanism and a developing device.

Subsequently, a configuration of a toner pressurizing supply mechanism 60 (developer supply portion) will be explained in details. The toner pressurizing supply mechanism 60 supplies toner via a conveying path 32 to the developing device 4 as illustrated in FIG. 2. In the present embodiment, the toner uses single magnetic component toner.

The toner pressurizing supply mechanism 60 includes a toner bottle 21 accommodating toner, and a pump accommodation unit 24 for supplying the toner accommodated in the toner bottle 21 from a toner discharge port 25 to the conveying path 32 according to a change in an internal pressure generated by a pump 23 (internal pressure variable unit).

As illustrated in FIG. 3A, a mechanism for supplying toner from the toner bottle 21 to the conveying path 32 includes the pump accommodation unit 24 for rotatably supporting the toner bottle 21 and a rotation driving mechanism 50 for driving and rotating the toner bottle 21. Then, with the rotation driving given by this rotation driving mechanism 50, the toner is guided from the toner bottle 21 to the pump accommodation unit 24. It should be noted that the toner bottle 21 is detachably attachable to the pump accommodation unit 24.

In the pump accommodation unit 24, a pump driving gear 51 is driven by a driving motor 56 controlled by a control device 55 as illustrated in FIG. 3B based on a toner remaining quantity detection result provided by a toner sensor 31 in the conveying path 32. Thereafter, when driving is given by the pump driving gear 51 via a driving reception portion 52, the pump driving member 54 joined by a joint portion 53 is driven, so that the pump 23 performs contraction operation. According to this contraction operation, air and toner are supplied from the toner discharge port 25 to the conveying path 32.

In the present embodiment, the pump 23 employs a pump made of resin and formed in bellows shape, which is a capacity variable type pump of which capacity can be changed according to reciprocal movement. This bellows-shaped pump is having multiple "mountain fold" portions and "valley fold" portions formed alternately in a periodical manner.

As illustrated in FIG. 2, the conveying path 32 has a conveying path screw 33 provided in a rotatable manner, and when this conveying path screw 33 rotates, the toner is conveyed in the direction of the developing device 4 (in a direction of arrow X as illustrated in FIG. 2). Thereafter, the toner is conveyed to a toner supply port 29 (supply path) provided at a downstream side in a conveying direction and at the one end portion of the developing device 4 in a longitudinal direction, and the toner is supplied from this toner supply port 29 to the developing device 4.

<Developing Apparatus>

Figure 4A:
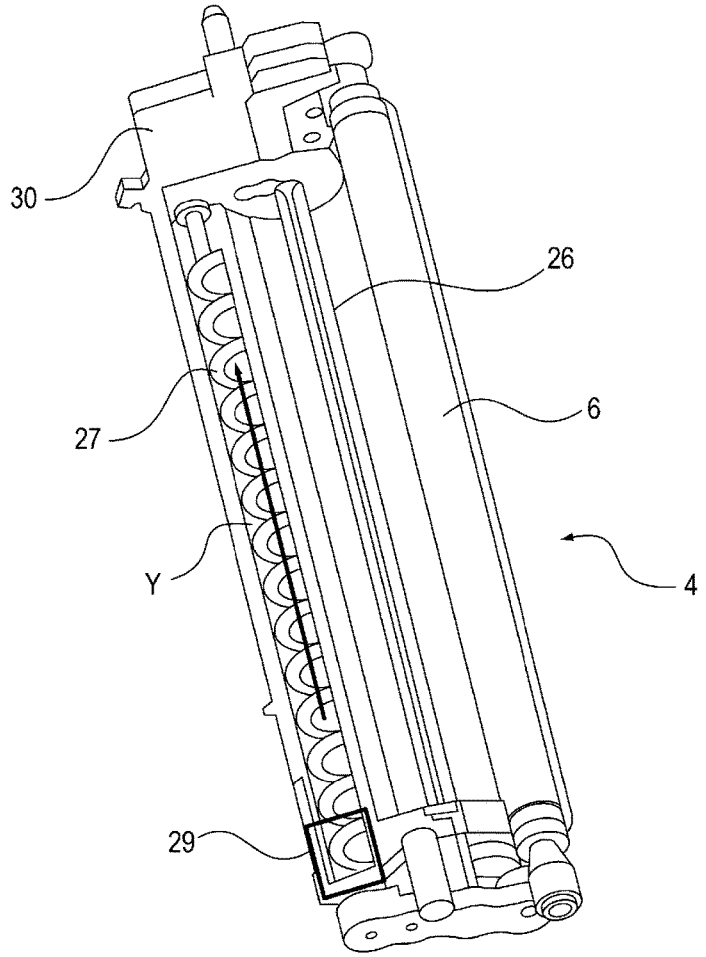
FIGS. 4A and 4B are a schematic perspective view and a cross sectional schematic view illustrating a developing device.
Figure 4B:
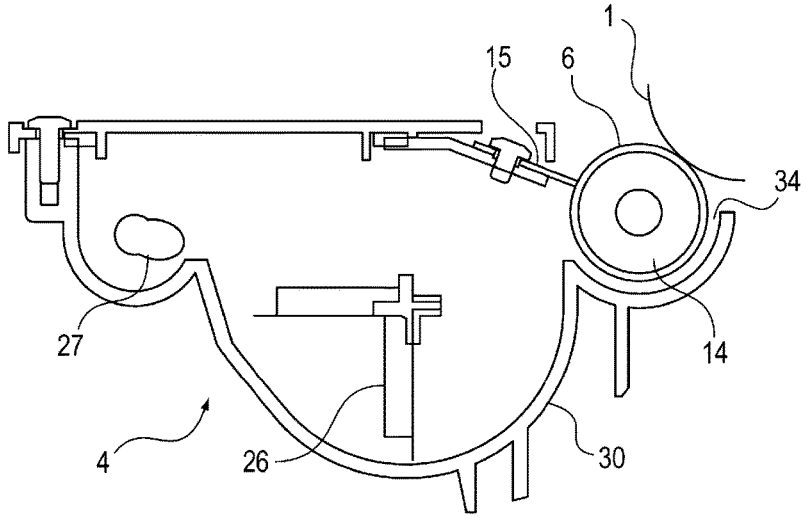

Subsequently, a configuration of the developing device 4 serving as a developing apparatus will be explained in detail. As illustrated in FIG. 4, the developing device 4 includes a housing 30, and the toner supplied from the toner pressurizing supply mechanism 60 is accommodated in the inside of this housing 30. More specifically, in the developing device 4, a portion for accommodating the toner (developer accommodation portion) is formed by the housing 30.

The developing device 4 includes a developing device screw 27, an agitation conveying member 26, a developing roller 6, and a developing blade 15. The developing roller 6 serving as a developer holding portion is provided in an open port 34 (discharge path) discharging toner from the developing device 4, and performing developing. The developing roller 6 includes a developing magnet 14 in the inside thereof. With the magnetic attraction force of the developing magnet 14, the toner is carried on the roller, and the toner is supplied to the electrostatic latent image formed on the surface of the photosensitive drum 1 to develop the electrostatic latent image. The developing blade 15 limits the film thickness of the toner carried on the developing roller 6. The developing device screw 27 is provided immediately below the toner supply port 29, and when the developing device screw 27 rotates, the developing device screw 27 conveys the toner, which is supplied to one end side of the developing device 4 in the longitudinal direction, to the other end side thereof in the longitudinal direction (in a direction of arrow Y in FIG. 4A). A portion of the toner conveyed by the developing device screw 27 drops to the side of the agitation conveying member 26 while the toner is conveyed. When the agitation conveying member 26 rotates, the toner is supplied to the developing roller 6 while the toner is agitated.

As illustrated in FIG. 2, a toner sensor 28 and a toner sensor 31 each detecting a toner remaining quantity are provided in the developing device 4 and in the conveying path 32, respectively. In the present embodiment, these toner sensors use magnetic permeability sensors to output a high output voltage when there is much toner, which is a magnetic substance, around the detection surface, and the toner sensors output a low output voltage when there is less toner. Accordingly, the toner remaining quantity can be detected from the obtained output voltage. In the present embodiment, the magnetic permeability sensor is used as the toner sensor, but the present invention is not limited thereto, the toner sensor may be a sensor for giving an output according to the amount of the toner.

As described above, the toner is supplied as follows. When the output of the toner sensor 31 in the conveying path 32 is equal to or less than a predetermined voltage, the rotation of the toner bottle 21 is started according to a command of the control device 55. When the output of the toner sensor 28 in the developing device 4 is equal to or less than a predetermined voltage, the conveying path screw 33 rotates according to a command of the control device 55 to supply the toner to the developing device 4.

<Spouting Out of Toner During Toner Supply Operation with Pump>

Figure 5A:
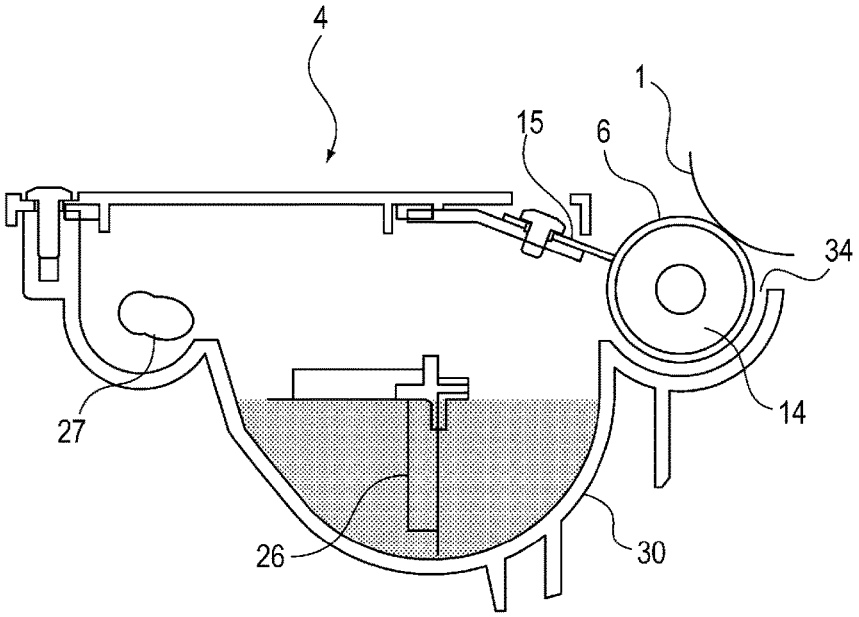
FIGS. 5A and 5B are figures illustrating a state of an agent surface of toner in a developing device before and after toner supply.
Figure 5B:
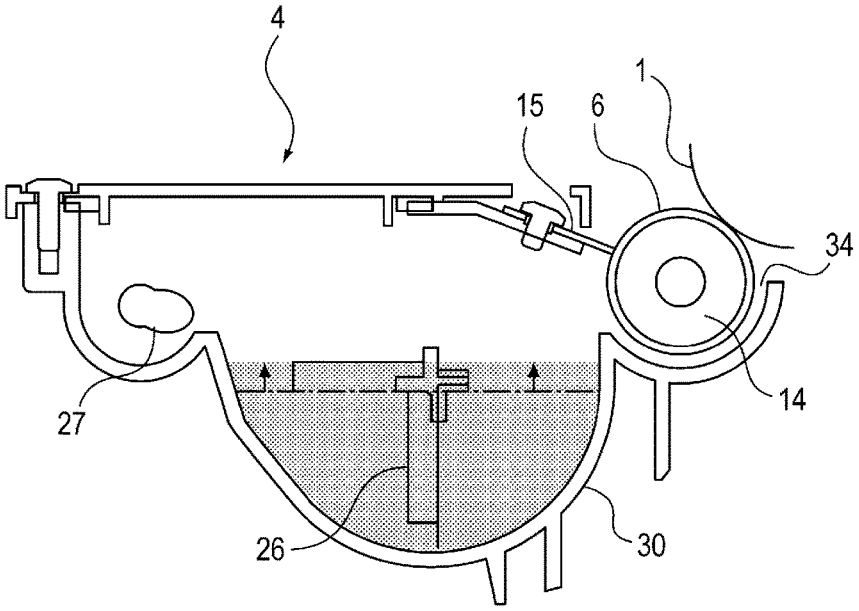

Subsequently, spouting out of toner during toner supply operation with pump 23 will be explained in details. FIGS. 5A and 5B are figures illustrating the state of the agent surface of the toner in the developing device 4 before the toner supply operation (FIG. 5A) and after the toner supply operation (FIG. 5B). According to a change in the internal pressure caused by contraction of the pump 23, the toner is supplied to the developing device 4, so that, as illustrated in FIGS. 5A and 5B, the agent surface of the toner in the developing device 4 rises, and the internal pressure in the developing device 4 increases. According to a change in the internal pressure, air is also supplied into the developing device 4, and therefore, the internal pressure in the developing device 4 increases. When a difference in the air pressure is generated between the inside and the outside of the developing device 4 according to an increase in the internal pressure in the developing device 4 when the toner is supplied as described above, the toner carried on the developing roller 6 at the border between the inside and the outside of the developing device 4 may spout out to the outside of the developing device 4 because of this effect. In this case, the spouted toner scatters in the image forming apparatus A to smear other members and sheets, so that this leads to a reduction in the image quality.

Therefore, in the developing device 4, the space volume of the developing device 4 is set so that a force Fair exerted on the toner carried on the developing roller 6 (hereinafter referred to as a spout out force Fair) according to the increase in the internal pressure in the developing device 4 due to contraction of pump 23 is not more than a force Ftnr for carrying the toner with the developing roller 6 (hereinafter referred to as carrying force Ftnr). More specifically, spout out force Fair carrying force Ftnr holds. Accordingly, the toner can be prevented from spouting out to the developing device 4. Hereinafter, this will be explained in a more specific manner.

First, the carrying force Ftnr will be explained. The carrying force Ftnr referred to herein is a force for carrying the toner with the developing roller 6, and is a force for the toner to stay on the developing roller 6 against the spout out force Fair when the spout out force Fair is exerted on the toner carried on the developing roller 6.

Figure 6:
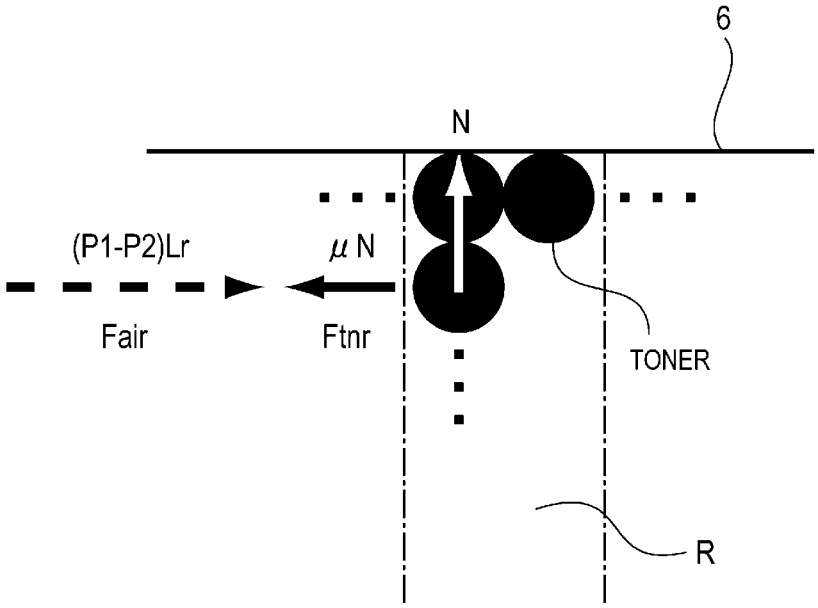
FIG. 6 is a figure for describing a force exerted on toner carried on a developing roller based on an air pressure difference.

As described above, a magnetic attraction force is exerted on the toner carried on the developing roller 6 in a direction to the developing roller 6 due to the effect of the developing magnet 14. At this occasion, let N be the summation of the magnetic attraction forces of the toners carried on the developing roller 6 in a region R that is most affected by the spout out force Fair when the spouting of the toner to the outside of the developing device 4 is considered (see FIG. 6). Let p be the friction coefficient of particles of the toner carried on the region R. Then, the carrying force Ftnr can be derived from the following expression 1.

$$\text{Ftnr}=\mu N \qquad \text{(Expression 1)}$$

Strictly speaking, in order to calculate the carrying force Ftnr, it is necessary to consider not only the friction coefficient μ between toner particles but also a friction coefficient between the developing roller 6 and the toner. However, in general, the friction coefficient between the developing roller 6 and the toner is larger than the friction coefficient between the toner particles. Therefore, the calculation result of the carrying force Ftnr is a calculation result obtained when the friction coefficient is the minimum, and therefore, unless the toner spouts out from the developing device 4 with this calculation result, the toner would not spout out from the developing device 4 regardless of whether the friction coefficient between the developing roller 6 and the toner is to be considered or not.

In the present embodiment, the single magnetic component toner is used as the toner, but as long as the summation N of the magnetic attraction forces and the friction coefficients of the toner particles are known, it may be possible to use other magnetic toners such as two magnetic component toner and the like. However, it is preferable to use the single magnetic component toner since the relationship between the magnetic attraction force and the toner quantity are clear.

Figure 7:
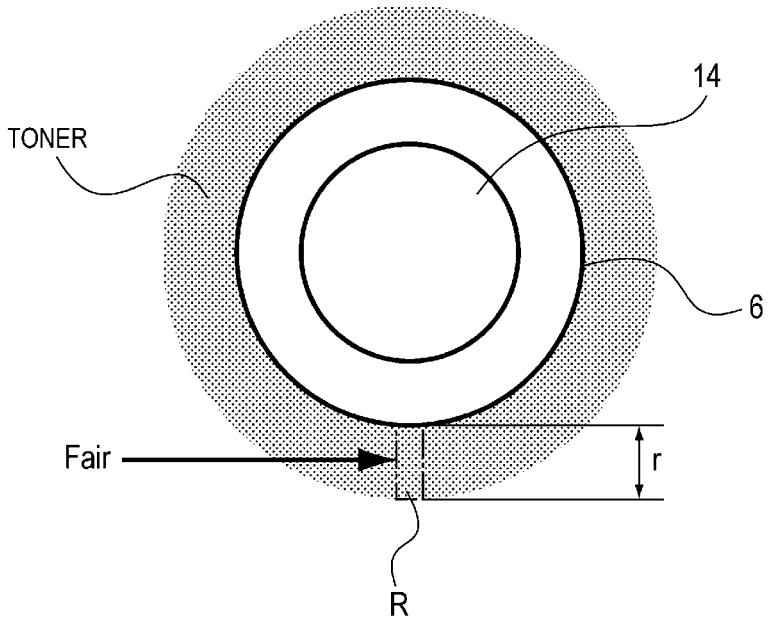
FIG. 7 is a figure for describing a force for carrying toner on the developing roller.

Subsequently, the spout out force Fair will be explained. As illustrated in FIG. 7, let L (not illustrated) be the length of the toner carrying region in the axial direction of the developing roller 6, and let r be the thickness of the toner carried on the developing roller 6. Then, the size of area of the region R is Lr. At this occasion, the size of the spout out force Fair exerted on the region R can be calculated from a product of the pressure and the size of area. Therefore, when the internal pressure of a developing device 30 before the toner supply is denoted as P1, and the internal pressure of the developing device 4 after the toner supply is denoted as P2, the spout out force Fair can be calculated from the following expression 2.

$$\text{Fair}=(P2-P1)Lr \qquad \text{(Expression 2)}$$

Strictly speaking, the toner is particles, and therefore, the force applied to the air existing between the toner particles and the force applied to the toner particle itself are different. However, the toner particles are compressed by the magnetic attraction force generated by the developing magnet 14, and therefore, the amount of air between toner particles is extremely small. Therefore, in the present embodiment, when the spout out force Fair is considered, only the force applied to the toner is considered.

Therefore, the internal pressure P1 of the developing device 4 before the toner is supplied is considered to be in the same state as the atmospheric pressure, since the inside and the outside of the device are ventilated with the developing roller 6 being the border therebetween. On the other hand, the internal pressure P2 of the developing device 4 after the toner is supplied can be derived from the following expression 3 based on Boyle's law, when let V1 (hereinafter simply referred to as a space volume V1) be a space volume not including the volume of the toner accommodated in the developing device 4 before the toner is supplied, and let V2 (hereinafter simply referred to as a space volume V2) be a supply volume of the toner and the air supplied due to contraction of the pump 23.

$$P2=P1\times V1/(V1-V2) \qquad \text{(Expression 3)}$$

In this case, the internal pressure P1 of the developing device 4 before the toner is supplied is considered to be in the same state as the atmospheric pressure as described above, and the internal pressure P1 can be predicted in advance. Therefore, when the values of the space volume V1 and the supply volume V2 are changed so that a predetermined amount of toner or less is accommodated in the developing device 4, the internal pressure P2 can be controlled, and the spout out force Fair can also be controlled.

As described above, the relationship Ftnr Fair can be satisfied, and this prevents the toner from spouting out to the outside of the developing device 4. The toner can be prevented from spouting out to the outside of the developing device 4 without using any filter, and therefore, it is not necessary to replace or maintain a filter with a regular interval, and the running cost can be reduced. Further, it is not necessary to consider clogging of the filter even when it is used for a long period of time, and the toner can be prevented from spouting out from the developing device 4 for a long period of time.

<Experiment Result>

Subsequently, a result of an experiment of presence/absence of toner spout out during toner supply will be explained with several types of developing devices 4 in which the ratio of the supply volume V2 during toner supply is changed with respect to the space volume V1 before the toner supply. In this experiment, the single magnetic component toner is used as the toner, and the toner of which friction coefficient between toner particles is 0.55 is used.

As illustrated in FIG. 8, in a condition 1, the supply volume V2 during toner supply with respect to the space volume V1 before the toner supply is 4%. As a result, the toner is not seen to spout out. In the calculation result, carrying force Ftnr>spout out force Fair also holds, and the experiment result matches the calculation result.

Subsequently, in a condition 2, the supply volume V2 during toner supply with respect to the space volume V1 before the toner supply is 8%. As a result, the toner is not seen to spout out. In the calculation result, carrying force Ftnr>spout out force Fair also holds, and the experiment result matches the calculation result.

Subsequently, in a condition 3, the supply volume V2 during toner supply with respect to the space volume V1 before the toner supply is 9%. As a result, the toner is seen to spout out. In the calculation result, carrying force Ftnr<spout out force Fair also holds, and the experiment result matches the calculation result.

Subsequently, in a condition 4, the supply volume V2 during toner supply with respect to the space volume V1 before the toner supply is 20%. As a result, the toner is seen to spout out. In the calculation result, carrying force Ftnr<spout out force Fair also holds, and the experiment result matches the calculation result.

According to the above experiment, the relationship of carrying force Ftnr<spout out force Fair is satisfied based on the expressions 1, 2, and 3, so that it is confirmed that the toner does not spout out from the developing device 4. When the single magnetic component toner is used as the toner, and the friction coefficient between the toner particles is equal to or more than 0.55, the space volume V1 of the developing device 4 is set so that the supply volume V2 with respect to the space volume V1 of the developing device 4 is equal to or less than 8%, so that it is confirmed that the toner can be prevented from spouting out from the developing device 4 without providing any filter.

In this experiment, the contraction cycle of the pump 23 is 0.3 seconds. This is because, in a case where the contraction cycle is equal to more than 0.3 seconds, the pressure instantaneously applied to the toner decreases, and therefore, the toner is less likely to spout out. Therefore, the contraction of the pump 23 is preferably performed with a cycle of 0.3 seconds or more.

Subsequently, a result of an experiment for confirming presence/absence of occurrence of a void image during image formation by changing the ratio of the volume of the toner in the developing device 4 with respect to the capacity of the developing device 4 will be explained. It should be noted that the coverage rate of the image is 100%.

As illustrated in FIG. 9, when an image is formed while the ratio of the volume of the toner in the developing device 4 with respect to the volume of the developing device 4 is 38% with respect to the capacity of the developing device 4, a void image phenomenon has not occurred.

On the other hand, when an image is formed while the ratio of the volume of the toner in the developing device 30 with respect to the capacity of the developing device 4 is 37% with respect to the space volume of the developing device 4, a void image phenomenon has occurred.

As a result, even in a case when the coverage rate of the image related to image formation is the maximum, and the toner is most greatly consumed in the image formation, it is found that no void image has occurred when the volume of the toner accommodated in the developing device 4 is 38% or more with respect to the capacity of the developing device 4. Therefore, toner is supplied so that the volume of the toner in the developing device 4 is 38% or more with respect to the capacity of the developing device 4, so that this can prevent a void image phenomenon of an image from occurring during image formation. It should be noted that the capacity of the developing device 4 includes the space volume of the developing device 4 and the volume of the toner supplied to the developing device 4.

The volume of the developing device 4 is 700 $cm^3$ or less, and the above effect of the developing device 4 according to the present embodiment can be obtained while the increase in the size of the developing device 4 is suppressed to the minimum level.

In the present embodiment, the developing device 4 is configured to be attached to the main body of the image forming apparatus A, but the present invention is not limited thereto. More specifically, even when the developing device 4 according to the present embodiment is used for a process cartridge having a photosensitive drum, a charging roller, a developing apparatus, and a cleaning blade and detachably attachable to an image forming apparatus, the effects of the present invention can be obtained.

In the present embodiment, the space volume in the developing device 4 is set so that the developer does not spout out according to the increase in the internal pressure due to the expansion and contraction of the pump 23. However, the same effects as the above effects can be obtained even when the space volume in the developing device 4 is configured to be dynamically variable, and the space volume in the developing device 4 is configured to increase so that the developer does not spout out even if the internal pressure increases when the toner is supplied due to expansion and contraction of the pump 23.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-209688, filed Oct. 26, 2015, which is hereby incorporated by reference herein in its entirety.

What is claimed is:

1. An image forming apparatus, comprising:

an image bearing member;

a bottle configured to accommodate a developer of a single magnetic component;

a pump unit configured to supply the developer with air from the bottle; and a developing apparatus configured to develop a latent image with the developer which is supplied by the pump, comprising:

a developer bearing portion having a magnetic body that generates a magnetic force and is configured to bear the developer with a carrying force working in a substantially perpendicular direction to the magnetic force; and a developer accommodation portion having a supply opening to receive the developer supplied by the pump and a discharge opening to discharge the developer, the developer accommodation portion accommodating the developer supplied from the supply opening and discharging the developer through the discharge opening to the image bearing member, and configured to have no opening other than the supply opening and the discharge opening, with the developer accommodation portion having a space volume so that a spouting force does not exceed the carrying force by the developer bearing portion, the spouting force acting on the developer born by the developer bearing portion in a discharging direction of the developer from the discharge opening which is caused by an increasing of an inner pressure when the developer is supplied by the pump in a state where a predetermined amount of the developer is stored.

2. The image forming apparatus according to claim 1, wherein the developer supplied to the supply opening is supplied with a predetermined pressure that increases the internal pressure.

3. The image forming apparatus according to claim 1, wherein the space volume of the developer accommodation portion is a space volume not including a volume of the developer accommodated in the developer accommodation portion.

4. The image forming apparatus according to claim 1, wherein when a friction coefficient between particles of the developer is 0.55 or more, the space volume of the developer accommodation portion is a space volume such that a volume of the developer supplied to the developer accommodation portion with one supplying process by the pump unit is 8% or less with respect to the space volume of the developer accommodation portion when the predetermined amount of the developer is accommodated.

5. The image forming apparatus according to claim 1, wherein the volume of the supplied developer is a volume including a volume of air supplied together with the supplied developer.

6. The image forming apparatus according to claim 1, wherein during image formation, the volume of the developer accommodated in the developer accommodation portion is 38% or more with respect to capacity of the developer accommodation portion.

7. The image forming apparatus according to claim 1, wherein when a friction coefficient between particles of the developer is 0.55 or more, the space volume of the developer accommodation portion is a space volume such that the volume of the supplied developer is 8% or less with respect to the space volume of the developer accommodation portion when the predetermined amount of the developer is accommodated, and the capacity of the developer accommodation portion includes the space volume of the developer accommodation portion and the volume of the developer accommodated in the developer accommodation portion.

* * * * *